United States Patent [19]

Gereby et al.

[11] Patent Number: 4,928,455

[45] Date of Patent: May 29, 1990

[54] PACKAGING MACHINE AND METHOD

[75] Inventors: John L. Gereby, Rocky River; Eric P. Gifford, Orange; Rick S. Wehrmann, Hudson; William M. Easter, Solon, all of Ohio

[73] Assignee: Automated Packaging Systems, Inc., Twinsburg, Ohio

[21] Appl. No.: 346,376

[22] Filed: Apr. 28, 1989

Related U.S. Application Data

[63] Continuation of Ser. No. 127,255, Dec. 1, 1987, abandoned.

[51] Int. Cl.[5] ..... B65B 43/26

[52] U.S. Cl. ..... 53/570; 53/385; 53/390; 53/373

[58] Field of Search ..... 53/570, 585, 390, 373

[56] References Cited

U.S. PATENT DOCUMENTS

| | | | |
|---|---|---|---|
| 3,165,870 | 1/1965 | Saumsiegle | 53/385 X |
| 3,448,555 | 6/1969 | Shabram | 53/570 X |
| 3,477,196 | 11/1969 | Lerner . | |
| 3,481,102 | 12/1969 | Dolman | 53/570 X |
| 3,815,318 | 6/1974 | Lerner . | |
| 3,882,656 | 5/1975 | Lerner . | |
| 3,965,653 | 6/1976 | Lerner . | |
| 3,965,654 | 6/1976 | Reubens | 53/385 X |
| 4,014,154 | 3/1977 | Lerner . | |
| 4,651,506 | 3/1987 | Lerner et al. . | |

*Primary Examiner*—John Sipos

*Attorney, Agent, or Firm*—Watts, Hoffmann, Fisher & Heinke Co.

[57] ABSTRACT

A tabletop machine for automatically loading and sealing flexible containers such as plastic bags forming part of a chain of bags. The apparatus includes structure for supporting a supply of preformed, interconnected bags which are sequentially fed to a loading station. At the loading station, the bag is inflated by a blower having a shutter controlled outlet so that the flow of inflation air is reduced or terminated during feeding and which provides a blast or surge of air to "pop" the bag open when the bag arrives at a loading station. A residual air stream maintains inflation of the bag. After loading, a clamping mechanism is activated which applies a substantially increasing clamping force as a clamp bar nears a heat sealing unit so that should an obstruction or other obstacle be encountered as the clamping bar moves towards the bag, motion in the clamping bar can be resisted by the obstacle without damage to the obstacle or clamping mechanism. While the bag is clamped to the heat sealing unit, a perforation breaking mechanism comprising a blade-like member driven into the web path intermediate a locked web feed roll and the heat sealing unit causes severance of the loaded bag along a line of weakness formed by perforations. A relatively small, low volume air compressor in combination with a storage tank is used to provide the motive force for fluid pressure operated actuators used to operate the clamping bar and the perforation breaking mechanism so that a single source of electrical power is all that is needed to operate the machine.

8 Claims, 9 Drawing Sheets

PACKAGING MACHINE AND METHOD

This application is a continuation, of application Ser. No. 127,255, filed Dec. 1, 1987, now abandoned.

TECHNICAL FIELD

The present invention relates generally to apparatus and methods for packaging and in particular to a machine and apparatus for automatically loading, sealing and serving a bag from a chain of interconnected bags.

BACKGROUND ART

Machines and methods for automatically loading and sealing a bag that forms part of a chain of bags have been suggested in the past. For example, in U.S. Pat. No. 3,477,196 which issued to Bernard Lerner and which is owned by the assignee of the present application, a machine is disclosed that automatically loads and seals an opened bag forming part of a chain of bags. Typically, the bags are formed from a plastic web or webs and contiguous bags are defined by appropriately positioned heat seals and perforations. The bags normally define an end opening which is formed by serveing one face along a line of perforations. The other face of each bag is connected by perforations to the adjacent, upstream bag.

Mechanisms have also been suggested for automatically severing a loaded bag from the chain. In U.S. Pat. Nos. 3,882,656 and 3,815,318, also owned by the assignee of the present application, a machine is disclosed which includes a pivotally movable clamping/heat sealing structure which rotates a loaded bag away from the chain of bags thereby causing severance of the bag along a line of weakness preferably formed by perforations.

In many commercially available machines, multiple power sources are needed in order to operate the machine. For example, some machines require electrical power for the drive motors and a source of pressurized air for drive actuators that operate various components forming part of the machine. In some machines a blower is used to provide a stream of air for inflating the bag at the loading station so that product or products can be inserted. In other machines, a separate source of pressurized air is used to provide a short pulse of air in order to effect bag inflation.

Many of these machines are large and cumbersome and require significant floor space in order to operate. Still others, which may be smaller in size, are complicated to operate and/or are difficult to load with a supply of bags. Changing the size of bags being used may require extensive readjustment and expensive machine downtime.

DISCLOSURE OF THE INVENTION

The present invention provides a new and improved apparatus and method for loading, sealing and severing a flexible container such as a plastic bag, from a chain of interconnected bags. In the preferred and illustrated embodiment, the invention is embodied in a table-top machine which requires only a source of electrical power in order to operate and which is relatively simple to maintain and in which the supply of bags can be easily replaced and/or changed.

According to the invention, the disclosed apparatus includes a web feed mechanism which sequentially advances a web defining a chain of bags in order to position a lead bag at a loading station. A blower inflates the bag after it reaches the loading station to facilitate its loading. In the preferred embodiment, a shutter mechanism controls an outlet of the blower so that a controlled stream of air is allowed to proceed to a nozzle positioned at the loading station only when a bag has been advanced to a loading position. During advancement of the lead bag, the shutter, at least partially closes off the blower outlet. As the lead bag reaches the load position, the shutter is opened, preferably abruptly by a fluid pressure operated actuator. With this arrangement, an initial pulse or surge of air is generated when the shutter first opens which causes the bag to be "popped" open. After a predetermined amount of time, the shutter is again closed. In the preferred embodiment, in the closed position, the shutter does not fully close the blower so that a residual stream of air continues to flow to the nozzle in order to maintain inflation of the bag as it is loaded. In the preferred and illustrated embodiment, the closed position of the shutter is adjustable in order to adjust this residual air stream to accommodate the product being loaded.

After loading the bag, a sealing mechanism is activated which includes a clamping bar that clamps the front and rear faces of the loaded bag to a heat sealing unit in order to form a heat seal that closes the bag. According to the invention, the mechanism for driving the heat seal clamping bar, applies a small or minimal force to the bar as it moves towards the bag. As the clamping bar nears the bag, the force applied to the bar is amplified so that a substantial clamping force is exerted when the bag is held between the clamping bar and the heat sealing unit. During most of the clamping movement, however, any obstacles or obstructions encountered by the clamping bar will normally prevent further movement in the bar without causing damage to the bar or the drive mechanism. In the preferred embodiment, a sensor detects this condition and signals the operator.

According to the invention, the loaded bag is severed from the chain of bags while being clamped by the heat sealing mechanism. In the preferred embodiment, a blade-like member extends from the machine, towards the web and contacts the web near or at the region where the perforations connecting the loaded bag to the chain are located. The web is restrained from movement upstream of the loaded bag by the web feed mechanism while the loaded bag is restrained from movement by the clamping bar. The blade-like, perforation breaking member contacts the web and urges it out of its normal path of movement causing the loaded bag to be severed from the chain along the perforations. In the preferred embodiment, the blade-like member is V-shaped, with the apex of the "V" located near the center line of the chain. With this configuration, the severance of the loaded bag from the web begins near the center line of the web and progresses outwardly towards the marginal edges. As a result, the severance is achieved in a controlled fashion with minimal distortion and/or tearing.

According to a feature of the invention, the mechanism for achieving the force amplification as the clamping bar nears or contacts the loaded bag, comprises a toggle mechanism operated by a fluid pressure operated actuator. The toggle includes two pivotally mounted toggle links that are interconnected at a common pivot. One of the toggle links is connected to the force applying, fluid pressure operated actuator. The other link is operatively connected to a lever arm that is fixed to the clamping bar. According to the invention, the links are driven towards an inline, aligned position by the actuator. During movement towards the aligned position, the force exerted by the clamping bar is substantially reduced as compared to the final force applied by the bar when it is engaging the heat sealing unit. As a result, should an object be lodged between the clamping bar and the heat sealer, movement in the clamping bar will be inhibited and will not substantially damage the bag or the object. As the toggle links approach their aligned position which is selected to occur when the clamping bar is near or in contact with the heat sealer, the force applied by the clamping bar rises dramatically so that a large clamping force is applied during the actual sealing operation.

The disclosed packaging apparatus is extremely compact and in the illustrated embodiment is intended to function as a table-top unit. Because the machine only requires a source of electrical power, and does not require a separate source of pressurized air, it can be used in virtually any environment including both office and manufacturing applications.

Additional features of the invention will become apparent and a fuller understanding obtained by reading the following detailed description made in connection with the accompanying drawings.

Best Mode for Carrying Out the Invention

Figure 1:
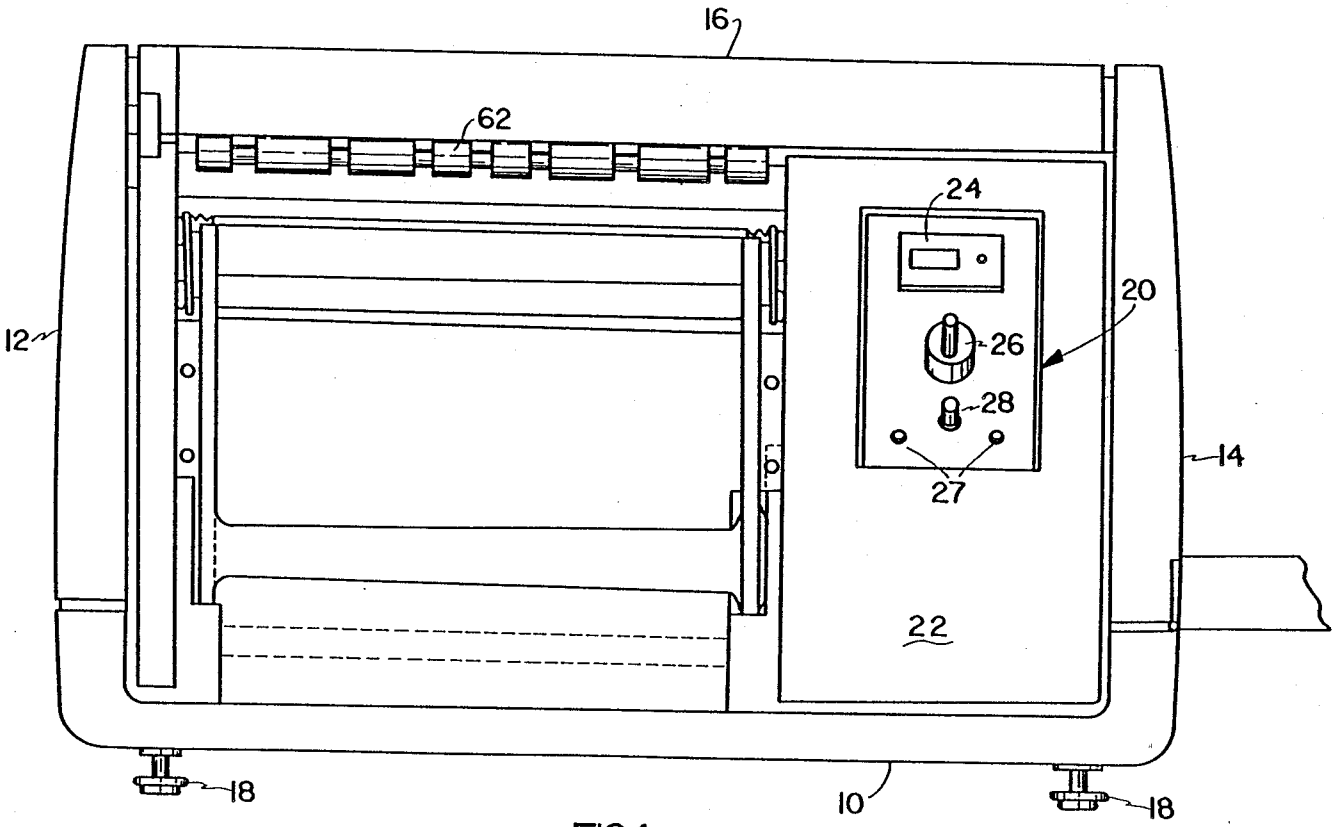
FIG. 1 is a front elevational view of a bagging machine embodying the present invention.
Figure 2:
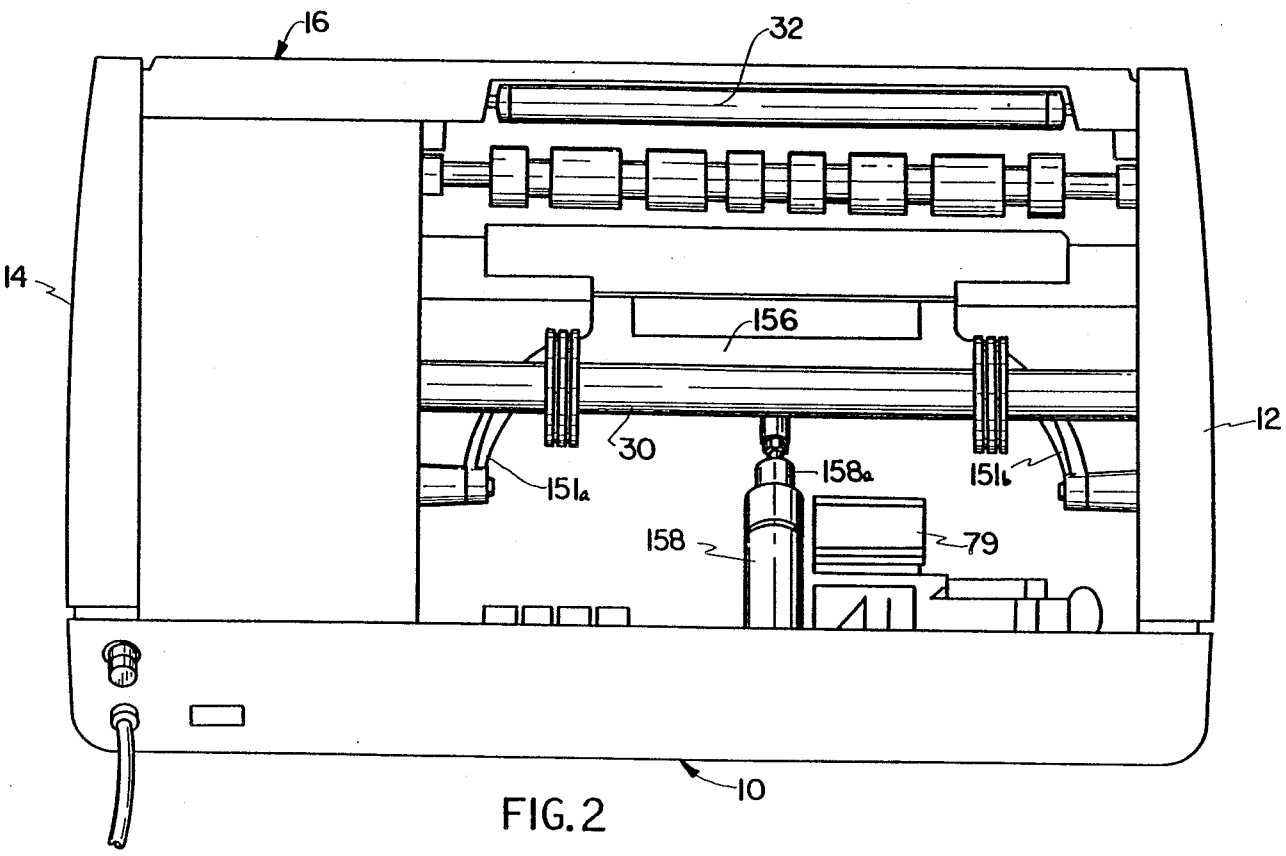
FIG. 2 is a rear elevational view of the machine shown in FIG. 1.

FIGS. 1 and 2 illustrate the overall outward appearance of an automatic bagging machine embodying the present invention. The bagging machine includes a cabinet defined by a base 10, a pair of side covers 12, 14 and a raisable top cover 16. In the preferred embodiment the side cover 14 can be opened in order to gain access to the interior of the machine. The base 10 is supported by a plurality of support legs 18 (shown only in FIG. 1). A control panel indicated generally by the reference character 20 is mounted on a front panel 22 and includes a counter 24, a machine cycle control knob 26 and display lights 27 which may indicate that power is applied and that a heat sealer (to be described) is operating. A seal point adjustment 28 is also provided for adjusting the temperature of the heat sealer.

Figure 5:
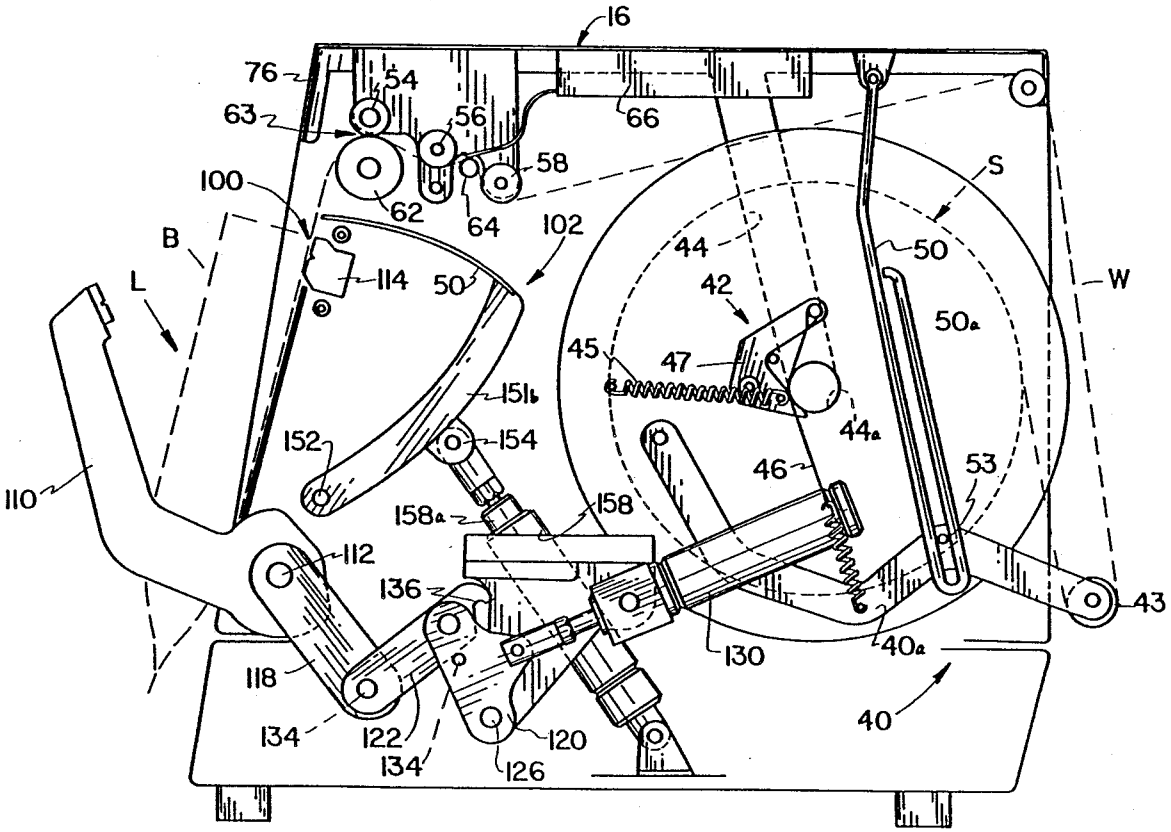
FIG. 5 is a view similar to FIG. 3 showing the machine loaded with a supply of bags and with a top cover closed.
Figure 6:
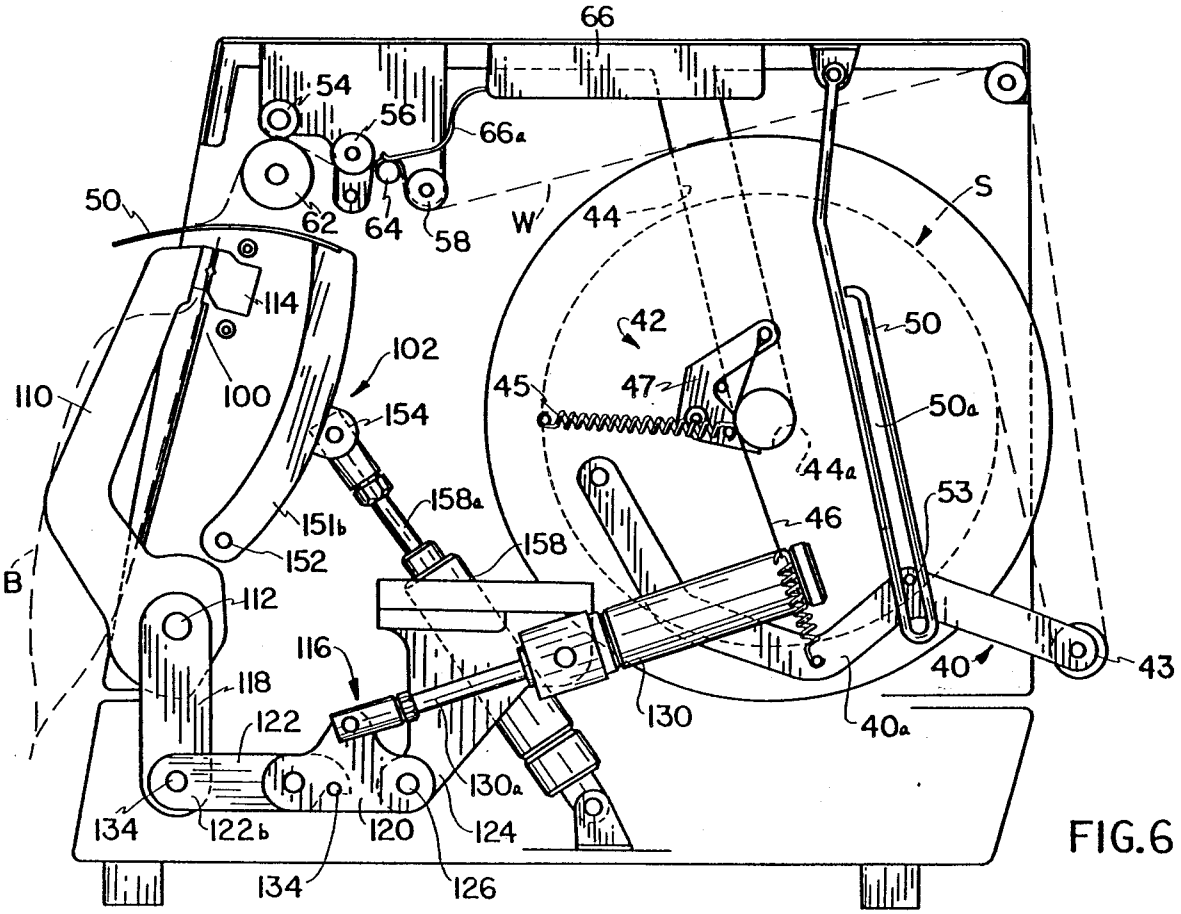
FIG. 6 is a view similar to FIG. 5 showing various elements in a position they assume when a loaded bag is sealed and severed from a chain of bags.

As seen from the rear of the machine (FIG. 2), the machine includes a spindle 30 which is adapted to support a supply of bags S (shown in FIGS. 5 and 6). The cover 16 is pivotally mounted at the rear of the machine and is raisable in order to gain access to the support spindle 30 and, as will be described further on in this description, allows a supply of bags S, mounted onto the spindle, to be lowered into the interior of the machine. As seen from the rear, a guide roller 32 is rotatably mounted to the top cover 16 and forms part of a guide path for a web of bags W (shown in FIGS. 5 and 6).

Figures 3, 3A:
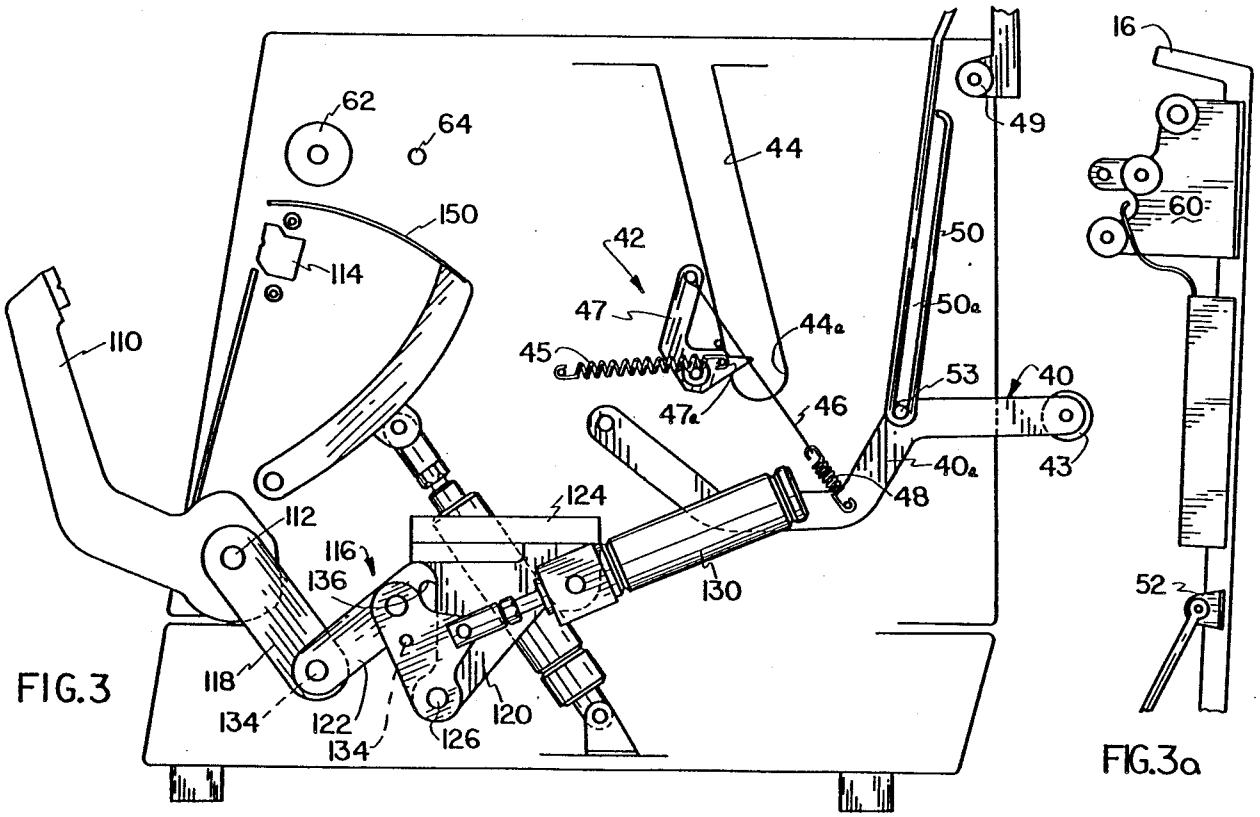
FIGS. 3 and 3*a* are side views of the machine with a top cover in a raised position, a side panel removed and other parts omitted for clarity, showing features of the invention.

Turning now to FIGS. 3 and 3*a*, the machine is shown, somewhat schematically, in an unloaded condition with the top cover 16 raised, ready to be loaded with a supply of bags. FIG. 5, on the other hand, shows the machine, somewhat schematically, with the top cover 16 closed, a supply of bags S loaded in position, and the web W fed along the web path defined within the machine.

As seen in these two figures, the machine includes a dancer roll assembly 40 for controlling tension in the web which cooperates with a brake mechanism 42 to supply a frictional force to the spindle 30 to retard its rotation and hence apply tension to the web W (shown in FIG. 5). The machine includes structure defining a pair of slots 44 (only one slot 44 of the pair is shown in FIG. 3) which receive the spindle 30. An arcuate base portion 44*a* of each slot rotatably supports the spindle.

Referring also to FIG. 3*a*, the top cover 16 is pivotally mounted at the rear of the machine by pivot pins 49. A link 50 extends between a clevis 52 fixed to the top cover 16 and the dancer roll assembly 40 and automatically raises a dancer roll 43 whenever the cover is moved to its open position shown in FIG. 3. The link 50 defines a slot-like opening 50*a* that slidably engages a pin 53 attached to a dancer roll arm 40*a*.

The brake mechanism 42 includes a friction band 46 attached at one end to the dancer arm 40*a* by a spring 48. The opposite end of the friction band is attached to an upper end of a pivotally mounted L-shaped lever 47 having an anvil like lower portion 47*a*. A spring 45 urges it towards a retracted position shown in FIG. 3. When a supply of bags S is loaded into the machine, an end of the spindle 30 engages the anvil portion 47*a* and causes the lever 47 to rotate clockwise to the position shown in FIG. 5. In this position the friction band 46 is slightly wrapped around the shaft 30 and applies a frictional force to the shaft to inhibit or resist its rotation. The dancer roll 43 moves downwardly as the web is payed out from the supply S. The resulting increased tension applied to the friction band, increases the frictional force applied to the shaft 30.

A plurality of guide rollers 54, 56, 58 are mounted between brackets 60*a*, 60*b* (shown in FIG. 4) fixed to the underside of the top cover 16 near its leading edge. The roller 54 engages a feed roll 62 whenever the top cover is closed and as seen in FIG. 5, defines a nip 63 through which the web W is fed. The feed roller 62 is driven in order to feed a bag B defined by the web to a loading position (shown in FIG. 5).

The rolls 56, 58 guide the web W over a shaft 64 mounted on the inside of the machine which together with a perforation detection assembly 66 detects the presence of a line of perforations in the web. The lines of perforations define the boundary line between adjacent bags. The perforation detector 66 is conventional and includes a detector arm 66a. The detector 66 does not form part of the present invention and need not be detailed further.

Figure 4:
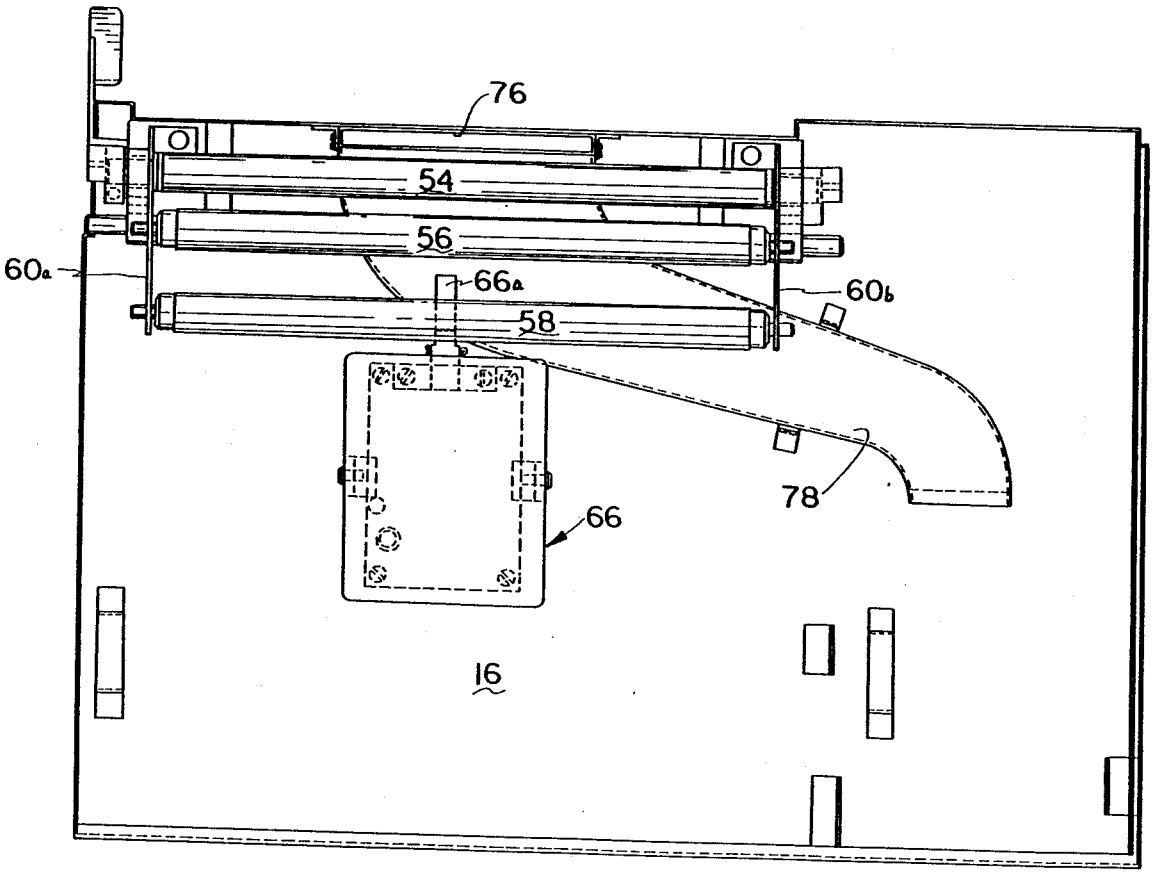
FIG. 4 is a side elevational view of the inside of the top cover shown in FIG. 3*a*.

The feed roll 62 is activated to pull web material from the supply S and to drive a lead bag B to a loading position indicated generally by the reference character L in FIG. 5. Each bag is perferably defined by two overlying plastic plies that are joined together along their longitudinal edges. Conventional transverse heat seals (not shown), spaced longitudinally along the web, define adjacent bags. A line of perforations (not shown) is located between adjacent bags and defines the separation line for the bags. In the preferred embodiment, the perforations connecting one ply of the bag are severed during a bag making process. As the lead bag moves to the load position L, the bag is inflated or opened by a blower 70 (shown in FIG. 7). Referring also to FIG. 4, a nozzle 76 is positioned near the leading edge of the top cover 16 and directs air downwardly towards the open end of the bag B. A conduit 78 is mounted to the underside of thee top cover 16 and is arranged to engage an outlet 70a of the blower 70 (shown in FIG. 4) when the top cover is closed thereby defining a continuous air flow path from the blower 70 to the nozzle 76.

Figure 7:
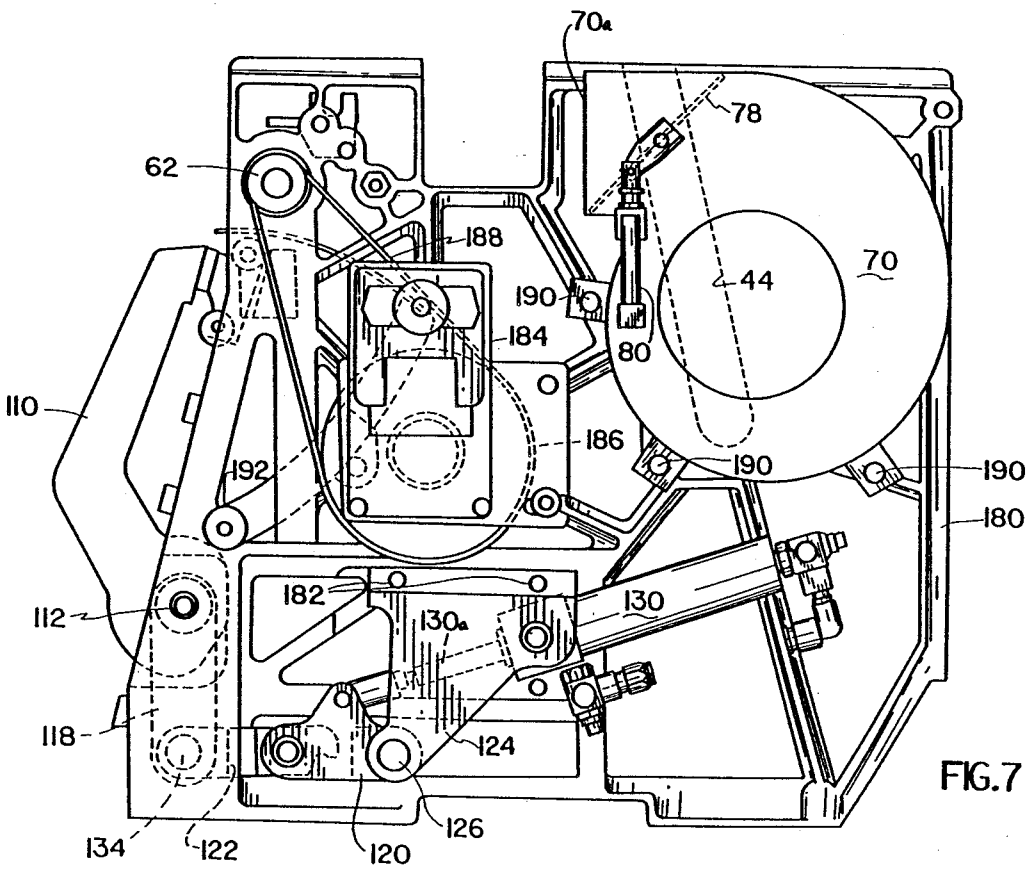
FIG. 7 is a side view of a frame member forming part of the machine with certain operating mechanisms shown attached to the frame.
Figure 9:
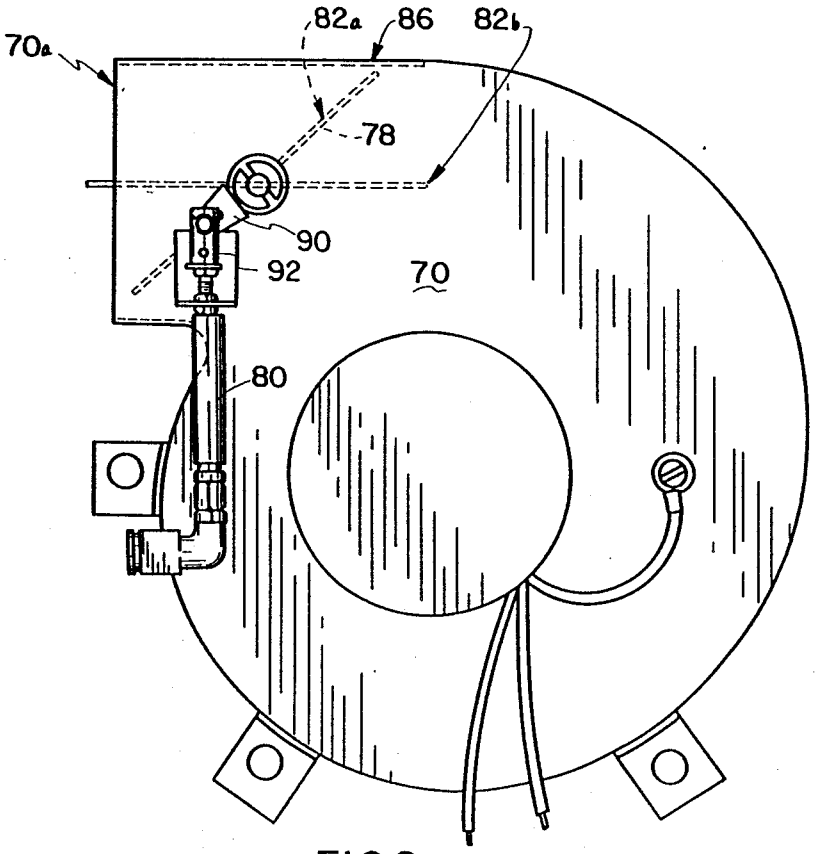
FIG. 9 is a side elevational view of a blower including a fluid pressure operated shutter mechanism forming part of the present invention as seen from a plane indicated by the line 9—9 in FIG. 10; and, FIG. 10 is an end view of the blower shown in FIG. 9.
Figure 10:
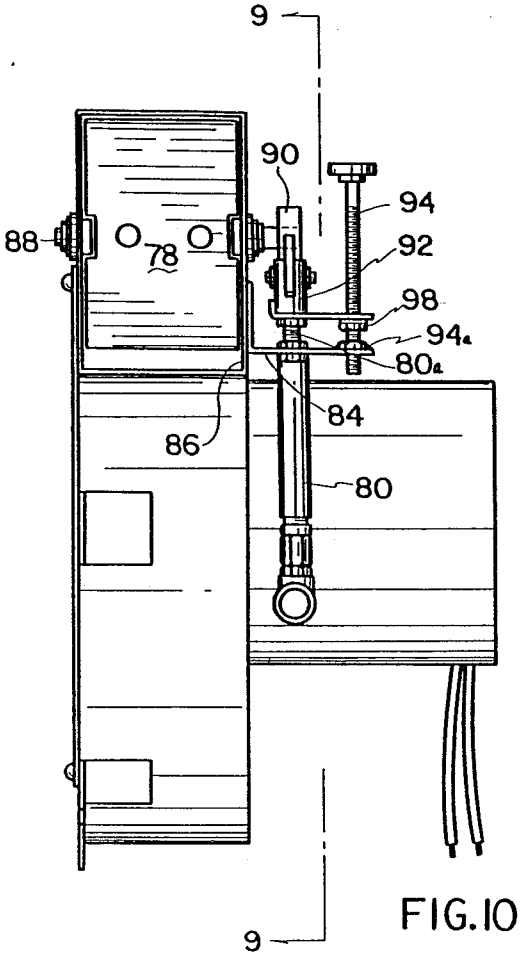

According to the invention, and as best seen in FIGS. 7, 9 and 10, a shutter 78 is mounted in or near the outlet 70a of the blower 70 and is operative to reduce or shut off the flow of air to the nozzle 76 when it is closed (the closed position is indicated in FIG. 9 by the reference character 82a). In the preferred and illustrated embodiment, the shutter is operated by a fluid pressure operated actuator 80. The communication of pressurized air to open and close the shutter is provided by a suitable control valve (not shown). In the preferred embodiment, a source of pressurized air provided by a small, electrically powered, air compressor 79 (shown in FIG. 2) is provided and eliminates the need for connecting the machine to a separate pressurized air source at the operating site.

The shutter provides several functions. During the time the lead bag B is being fed to the loading position, the air flow to the nozzle 76 is reduced or even terminated ensuring that the feeding of the bag is not interfered with. Secondly, when the bag reaches the loading position, the shutter 78 is abruptly opened by the actuator 80 and generates a "blast" or surge of air which tends to "pop" the bag open. Thirdly, during loading of the lead bag B, the shutter is normally adjusted to provide a residual air stream to maintain inflation of the bag.

Figure 8:
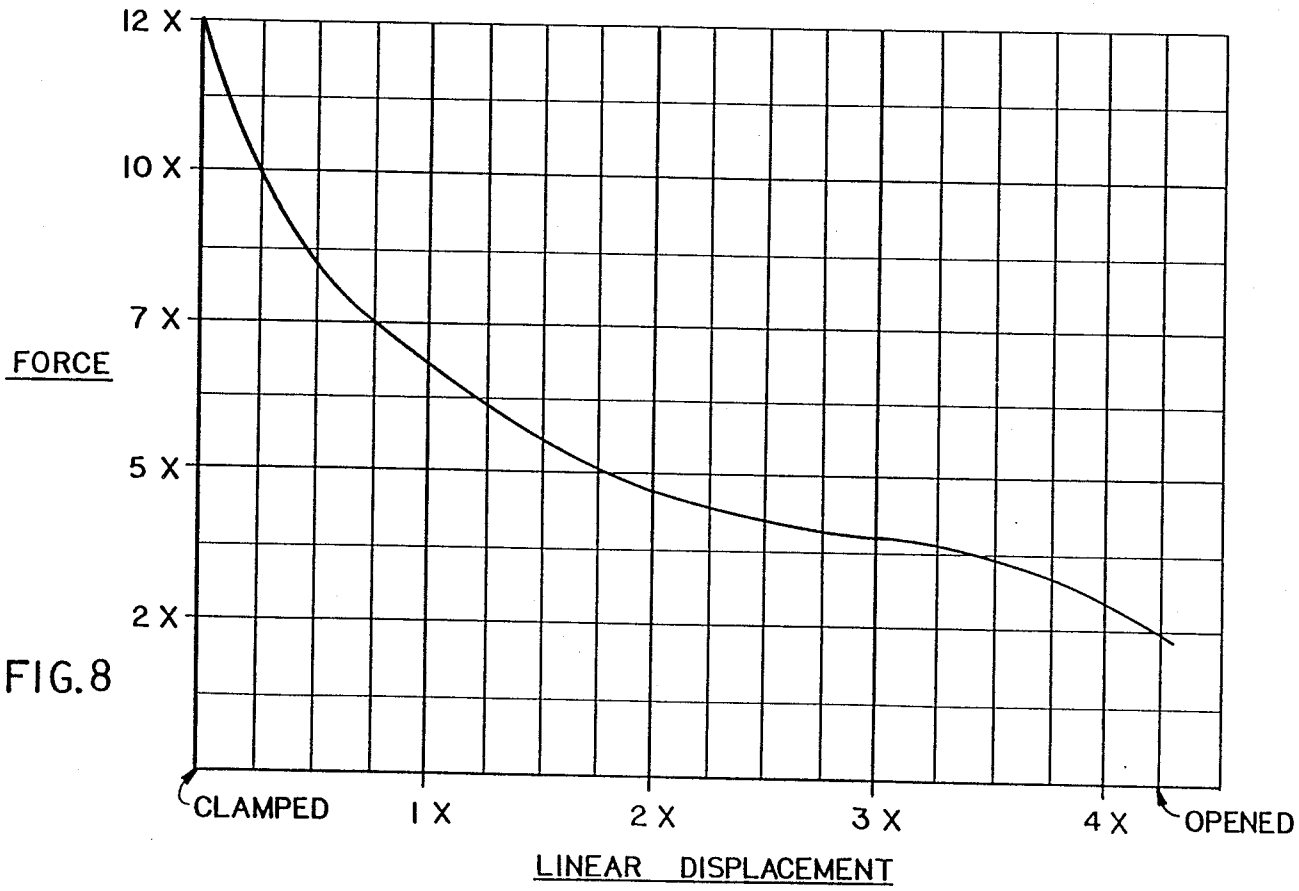
FIG. 8 graphically illustrates the functional relationship between the force applied by the clamping bar and its displacement from the heat sealing unit.

Turning to FIGS. 8 and 9, the mechanism for achieving these features is illustrated. The actuator 80 is mounted to the blower 70 by an L-shaped bracket 84 which is spot welded to a blower housing portion 86. The shutter 78 is attached to a shaft 88, the right end of which (as viewed in FIG. 10) mounts an operating arm 90. The arm 90 is pivotally connected to a clevis 92 attached to a rod end 80a of the actuator 80. As should be apparent from FIG. 9, extension of the actuator causes the shutter to rotate clockwise towards the open position indicated by the reference character 82b about the support shaft 88.

According to a feature of the invention, the closed position of the shutter 78 (indicated by the reference character 82a in FIG. 9) is adjustable. In particular, an adjustment thumb screw 94 is threadedly received by a nut 94a fixed (as by welding) to the actuator support bracket 84. The rod end 80a of the actuator 80 also carries a stop bracket 96 and includes an aperture (not shown) through which the thumb screw 94 extends. The aperture is sized to provide a substantial clearance fit for the thumb screw shaft. An abutment for the stop bracket defined by a nut 98 is suitably secured to the thumb screw. Rotation of the thumb screw 94 into or out of the fixed nut 94a lowers or raises, respectively, the nut 98. This in turn changes the rest position of the stop bracket 96 (the position at which the stop bracket abuts the nut 98) and hence determines the closed position of the shutter 78. Retraction of the actuating rod, in the preferred embodiment, is provided by a return spring forming part of the actuator 80.

In use, the closed position of the shutter 78 is adjusted to accommodate the product being loaded. For example, when a powdered material is being loaded, the shutter position is adjusted to provide a very small residual air stream so that the product is not blown from the bag as it is being loaded. For heavier products, the closed position of the shutter 78 can be adjusted to provide a substantial residual air stream.

According to a feature of the invention, the bag B is automatically sealed by a sealing mechanism indicated generally by the reference character 100, after it is loaded. During or after the sealing process, the loaded and sealed bag is severed from the rest of the web W by a perforation breaking mechanism indicated generally by the reference character 102. Referring to both FIGS. 5 and 6, the sealing mechanism 100 includes a clamping bar 110 mounted for pivotal movement about a fixed pivot 112. The clamping bar 110 is driven towards and away from a heat sealing unit 114 which may comprise the heat sealer disclosed in co-pending application Ser. No. 031,750, filed Mar. 30, 1987 which is owned by the present assignee. The heat sealing unit does not form part of the present invention and hence will not be described further.

According to a feature of the invention, the force applied by the clamping bar 110 to the bag B rises dramatically just prior to reaching clamping engagement with the heat sealing unit 114. During most of the transition from the fully retracted position shown in FIG. 5 to the fully clamped position shown in FIG. 6, substantially reduced force is applied by the clamping bar 110.

To achieve this feature, a fluid pressure operated toggling mechanism 116 is employed. The mechanism includes an operating lever 118 fixedly connected to the clamping bar 110 which also rotates about the pivot 112. The toggle mechanism includes first and second toggle links 120, 122. The first toggle link 120 is pivotally connected to a bracket 124 suitably fixed to a frame member (shown in FIG. 7) forming part of the machine. A fluid pressure operated actuator 130 is operatively connected to the first link 120 a spaced distance from a pivot 126 to which one end 120a of the toggle link 120 is connected. As should be apparent, extension and retraction of an actuating rod 130a forming part of the actuator 130 rotates the first toggle link 120 counterclockwise and clockwise, respectively about the pivot 126. Another end 120b of the first toggle link 120, opposite the end 120a connected to the bracket 124, is pivotally interconnected with one end 122a of the second toggle link 122. The second toggle link in turn is pivotally connected at its other end 122b to the operating lever 118 via a pivot 134. As should be apparent from FIGS. 5 and 6, as the actuator 130 is actuated to extend its actuating rod 130*a*, the operating lever 118 connected to the clamping bar 110 is rotated clockwise and moves the clamping bar 110 towards the heat sealing unit 114. Moreover, as the actuating rod 130 extends, the first and second toggle links 120, 122 move towards an aligned position (shown in FIG. 6) at which all three pivots 126, 130, 132 are substantially in line. A blocking pin 134 mounted to the first toggle link 120 cooperates with a slot 136 defined by the second toggle link 122 and prevents the two links 120, 122 from moving to an "over center position."

As the toggle links 120, 122 reach the aligned position shown in FIG. 6, the clamping force applied by the clamping bar 110 to the bag B held between itself and the heat sealing unit 114, rises substantially. In theory, when the toggle links 120, 122 are in the aligned position shown in FIG. 6, substantially infinite force, is necessary to retract the clamping bar because the lines of action for the pivot 132 and the pivot 126 are common and opposed. As a result the links 120, 122 act as an abutment.

While the loaded bag B is held between the clamping bar 110 and heat sealing unit 114, the perforation breaking mechanism 102 is actuated to separate the loaded bag from the remainder of the web W. In the illustrated embodiment the mechanism comprises a blade-like member 150 mounted between spaced support arms 151*a*, 151*b* (shown in FIG. 2) which pivot about a common pivot 152 (shown in FIGS. 5 and 6). A clevis 154 attached to a transverse support bar 156 (shown in FIG. 2) forming part of the perforation breaker 102 is operatively connected to a fluid pressure operated actuator 158. When the actuator is pressurized to extend an actuating rod 158*a*, the perforation breaker 102 is rotated counterclockwise (as viewed in FIGS. 5 and 6) about the pivot 152 and drives the blade 150 through the web path causing the web to separate along a line of weakness, defined by a line of perforations (not shown) located in the web between the heat sealing unit 114 and the feed roll 162. The feed roll 162 is preferably locked or braked to inhibit rotation. In the preferred and illustrated embodiment, a drive motor 180 including an integral brake assembly is used to control rotation. When the motor is energized, the brake is automatically released allowing the motor to rotate the feed roll 162. When the motor 180 is de-energized, a conventional brake mechanism is automatically applied which locks or inhibits rotation of the feed roll 162.

With the disclosed invention, a relatively compact, table-top bagging machine can be realized. The use of a shutter controlled blower in combination with a compact, small volume air compressor enables the machine to be powered by source of electricity only. It does not require a separate source of pressurized air as is the case with many prior art units. The low volume air compressor in combination with a conventional air accumulator provides a sufficient volume of pressurized air to operate the various actuators used to clamp the loaded bag for sealing and sever it from the remainder of the web. The large volume of low pressure air that is normally required to open the bag at the loading station is provided by a separate blower 70.

FIG. 8 illustrates the relationship between displacement of the clamping bar 110 and the force applied to the clamping bar 110 by the toggle mechanism 102. The retracted position of the clamping bar shown in FIG. 5 is indicated at the rightmost end of the curve in FIG. 8. The clamped position shown in FIG. 6 is indicated at the leftmost end of the curve, i.e. where the curve meets the vertical axis. As seen in the curve, the force increases gradually for a major portion of its travel towards the heat sealing unit 114. However, near the end of its travel, i.e. the section of the graph between 0 and 1 X, the force applied by the clamping bar 110 increases substantially. With the disclosed force versus displacement relationship, an obstruction or other hindrance to movement encountered during the initial displacement of the clamping bar 110 inhibits further movement in the bar. As the clamping bar 110 reaches the heat sealing unit 114, the force increases substantially in order to provide the necessary heat sealing contact between both plies of the bag and the heat sealing unit.

It should be noted that an opened bag at the loading station may be filled manually by an operator or alternately by an automatic feeding system that would feed product into the open bag and then provide a signal to the machine to seal and sever the loaded bag from the remainder of the web.

Referring to FIG. 7, further details of the preferred construction of the bagging machine are illustrated. The machine preferably includes a pair of spaced apart frame members 180 (only one frame member is shown in FIG. 7) which rigidly supports the various mechanisms and machine components. In the preferred embodiment, each frame member defines the slots 44 which rotatably support the supply spindle 30. As seen in FIG. 7, the bracket 124 for supporting the first toggle link 120 is suitably attached to the frame 180 by fasteners 182. The drive motor 184 (for periodically driving the web feed roll 62) is attached to the frame and as described above, is operatively connected to the web feed roll 62. In particular, the drive motor 184 drives a pulley 186 which in turn drives the feed roll 62 by a belt 188. The blower 70 for inflating a bag at the loading station is mounted to the frame member 180 by a plurality of fasteners 190. As also seen in FIGS. 3–6, the fluid pressure operated actuator 130 for operating the toggle mechanism 116 is pivotally connected to the bracket 124. The pivot 152 (shown in FIG. 6) which supports the perforation breaking member 150 is defined by pins 192 that extend from the frame member 180.

Although the invention has been described with a certain degree of particularity, it should be understood that those skilled in the art can make various changes to it without departing from the spirit or scope of the invention as hereinafter claimed.

We claim:

1. A table top packaging machine, comprising:

(a) a machine housing including a raisable top cover;

(b) a first guide structure carried by said top cover and second guide structure carried by a frame portion in said machine which together define a path of travel for a web of interconnected bag-like containers, when said cover is closed;

(c) web advancing means operative to periodically advance said web along said path to successively position each of said containers at a loading station;

(d) means for expanding a container positioned at said loading station, comprising:

(i) an electrically operated blower including a shutter controlled outlet;

(ii) a nozzle position near said loading station for directing air towards a mouth of said container;

(iii) conduit means for connecting said shutter controlled outlet with said nozzle;

(e) container separating means for severing a loaded container from said web comprising:

(i) a blade-like member movable into and out of a portion of said web path intermediate a heat sealing assembly and said web advancing means in order to sever said container along a line of weakness;

(ii) fluid pressure actuating means for effecting reciprocal movement in said blade-like member;

(f) said heat sealing assembly comprising:

(i) a clamping bar movable towards and away from a heat sealing unit;

(ii) a toggle mechanism for driving said clamping bar towards and away from said heat sealing unit and operative to apply an increasing clamping force to said clamping bar as said bar approaches said sealing unit;

(g) an electrically powered air compressor forming part of said packaging machine for providing a source of pressurized air for said fluid pressure actuator.

2. The apparatus of claim 1 wherein said shutter controlled outlet of said blower is operated by a fluid pressure operated actuator.

3. The apparatus of claim 2 further comprising an accumulator for accumulating pressurized air generated by said compressor.

4. The apparatus of claim 1 wherein said blade-like member is supported between and suspended by a pair of pivotally mounted operating arms.

5. The apparatus of claim 1 further comprising a dancer roll assembly for controlling the discharge of said web from a supply of containers, said dancer roll assembly operatively connected to said top cover such that when the top cover is raised, said dancer roll assembly is also raised in order to facilitate loading of the machine.

6. The apparatus of claim 1 further including disconnection means for decoupling said conduit means from said blower when said top cover is raised.

7. The apparatus of claim 1 wherein said web advancing means comprises an electrically powered motor having an integral brake mechanism which automatically brakes an output shaft when said motor is deenergized.

8. The apparatus of claim 1 wherein said web path is fully exposed when said top cover is raised in order to load a supply of containers into said machine, said web path is fully defined and supports said web after said top cover is closed.

* * * * *